US008152207B2

(12) United States Patent
Hartmann et al.

(10) Patent No.: US 8,152,207 B2
(45) Date of Patent: Apr. 10, 2012

(54) LOCK FOR A DOMESTIC APPLIANCE

(75) Inventors: Michael Hartmann, Höchstädt (DE); Dieter Hotz, Dischingen-Eglingen (DE); Cengiz Kücük, Syrgenstein (DE); Erich Schmid, Sontheim a.d.Brenz (DE); Martin Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 396 days.

(21) Appl. No.: 11/918,824

(22) PCT Filed: Apr. 13, 2006

(86) PCT No.: PCT/EP2006/061580

§ 371 (c)(1),
(2), (4) Date: Oct. 17, 2007

(87) PCT Pub. No.: WO2006/111502

PCT Pub. Date: Oct. 26, 2006

(65) Prior Publication Data

US 2009/0064735 A1 Mar. 12, 2009

(30) Foreign Application Priority Data

Apr. 19, 2005 (DE) ..... 10 2005 017 871

(51) Int. Cl.
*E05C 19/10* (2006.01)
*E05C 19/00* (2006.01)

(52) U.S. Cl. ..... 292/95; 292/335; 292/DIG. 4; 292/DIG. 11; 292/DIG. 69

(58) Field of Classification Search ..... 292/60, 292/335, DIG. 4, DIG. 11, DIG. 69
See application file for complete search history.

(56) References Cited

U.S. PATENT DOCUMENTS

| | | | | | |
|---|---|---|---|---|---|
| 293,424 | A | * | 2/1884 | Copeland et al. | 292/169.21 |
| 671,792 | A | * | 4/1901 | Comber | 292/2 |
| 1,372,000 | A | * | 3/1921 | Anderson | 292/216 |
| 1,411,059 | A | * | 3/1922 | Moore | 292/335 |
| 1,470,951 | A | * | 10/1923 | Andersen et al. | 292/137 |
| 1,662,450 | A | * | 3/1928 | Anderson | 292/335 |
| 2,145,112 | A | * | 1/1939 | Fedor, Jr. | 292/335 |
| 3,260,813 | A | * | 7/1966 | Dargene | 200/61.64 |
| 4,664,433 | A | * | 5/1987 | Solovieff | 292/337 |
| 5,090,751 | A | * | 2/1992 | Kobayashi | 292/71 |
| 5,364,138 | A | * | 11/1994 | Dietrich et al. | 292/1.5 |
| 5,401,067 | A | * | 3/1995 | Kurosaki et al. | 292/63 |

(Continued)

FOREIGN PATENT DOCUMENTS

EP 0 727 178 8/1996

(Continued)

OTHER PUBLICATIONS

International Search Report PCT/EP2006/061580.

*Primary Examiner* — Carlos Lugo
(74) *Attorney, Agent, or Firm* — James E. Howard; Andre Pallapies

(57) ABSTRACT

A lock for a movable closing element, especially a door, a cover, a flap, or similar on a domestic appliance such as a dishwasher, a washing machine, a refrigerator, or similar, includes a closing hook that can be made to engage with the closing element when being closed and made to disengage therefrom when being opened. The closing hook can be made to engage with a cavity in the closing element.

20 Claims, 6 Drawing Sheets

U.S. PATENT DOCUMENTS

| | | | | |
|---|---|---|---|---|
| 5,458,382 | A * | 10/1995 | Boadwine et al. | 292/337 |
| 5,775,748 | A | 7/1998 | Kurachi | |
| 5,997,056 | A * | 12/1999 | Yamagishi | 292/341.17 |
| 7,201,409 | B2 * | 4/2007 | Adachi et al. | 292/304 |
| 7,201,411 | B2 * | 4/2007 | Bella et al. | 292/336.3 |
| 7,234,735 | B2 * | 6/2007 | Harada | 292/170 |
| 7,726,705 | B2 * | 6/2010 | Kim | 292/163 |
| 7,775,565 | B2 * | 8/2010 | Hartmann et al. | 292/60 |
| 2006/0103140 | A1 * | 5/2006 | Bella et al. | 292/95 |
| 2007/0120376 | A1 * | 5/2007 | Bella | 292/163 |

FOREIGN PATENT DOCUMENTS

| | | |
|---|---|---|
| EP | 0 728 438 | 8/1996 |
| EP | 0 917 853 | 5/1999 |

* cited by examiner

LOCK FOR A DOMESTIC APPLIANCE

The invention relates to a lock for a domestic appliance.

BACKGROUND OF THE INVENTION

Domestic appliances, such as a dishwasher, a washing machine, a refrigerator, or similar, have a door, a cover, a flap, or similar, to allow loading or unloading to take place. For locking purposes, the door, the cover, the flap or similar operates in combination with a lock.

Document EP 0 728 438 B1 shows a locking device for a dishwasher, a cutout with a bridging piece arranged within it being provided in the upper edge of the dishwasher door. In the locking position, a downward pointing cantilever element arranged in the dishwasher casing engages in the cutout. The cantilever element has an opening underneath from which a peg element projects. In the locking position, the forward end of said peg element rests on the bridging piece in the cutout. When the door is moved into the locking position the peg is raised, thereby activating a microswitch.

A lock of this kind for the movable closing element on the domestic appliance, such as for the door, the cover, the flap or similar, can be attached to the body of the domestic appliance. The lock has a closing hook which in turn can be made to engage with the closing element when being closed and/or be made to disengage therefrom when being opened. A disadvantage of such a lock is the strong closing pressure needed to lock the closing element.

SUMMARY OF THE INVENTION

The object of the invention is to develop the lock further so that the closing pressure is reduced.

This object is achieved by means of a lock having the features, for example, of the exemplary embodiments described herein.

Appropriately the closing element is locked by the closing hook engaging with a cavity in the closing element. If the rotary door latch has been manually released by mistake without the closing element having been closed, the following embodiment still enables the closing element to be closed. For this purpose the closing hook is positioned in the sliding carriage by means of a spring. Moreover the contact surface of the closing hook is oblique to the closing element. When the closing element is closed, the closing hook is pressed into the sliding carriage due to the oblique contact surface and then slides back into the cavity in the closing element.

Lastly, the lock can also be designed having regard to an improvement in child safety. For this purpose, in the locking position a stopper dowel engages with the guide in such a way that movement of the dowel in the sliding carriage is blocked. As a measure of child safety, on the closing element being opened said stopper dowel can be unlatched so that it no longer engages with the guide. A lever which can be accessed from outside of the casing is arranged on the lock in order to actuate the stopper dowel manually.

The advantages obtained with the invention are in particular that the lock is sure to function and that it is easier to assemble. Moreover despite its greater functionality the lock is cost-effective and therefore particularly suitable for cost-sensitive domestic appliances.

BRIEF DESCRIPTION OF THE DRAWINGS

An exemplary embodiment of the invention, having various developments and designs, is shown in the drawings and described in greater detail below. The drawings show the following.

DETAILED DESCRIPTION OF THE EXEMPLARY EMBODIMENTS OF THE PRESENT INVENTION

Figure 1:
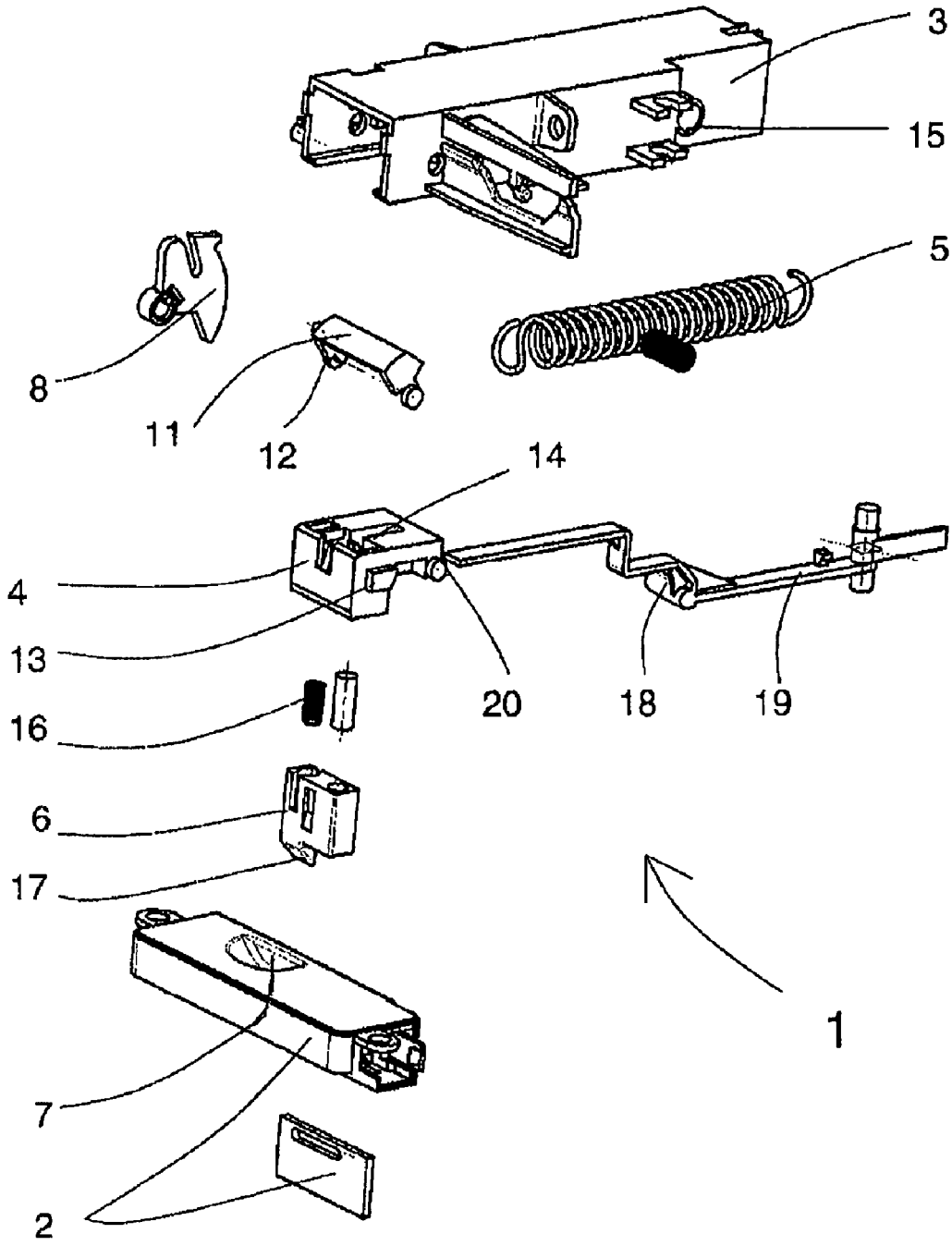
FIG. 1 An exploded view of a lock.

FIG. 1 shows the individual components of a lock 1 for a movable closing element 2. The closing element 2, indicated in the form of a diagram only, is intended for a door, a cover, a flap, or similar on a domestic appliance such as a dishwasher, a washing machine, a refrigerator, or similar, said closing element 2 being attached in a known way by means of a movable hinge to the body of the domestic appliance.

Figure 2:
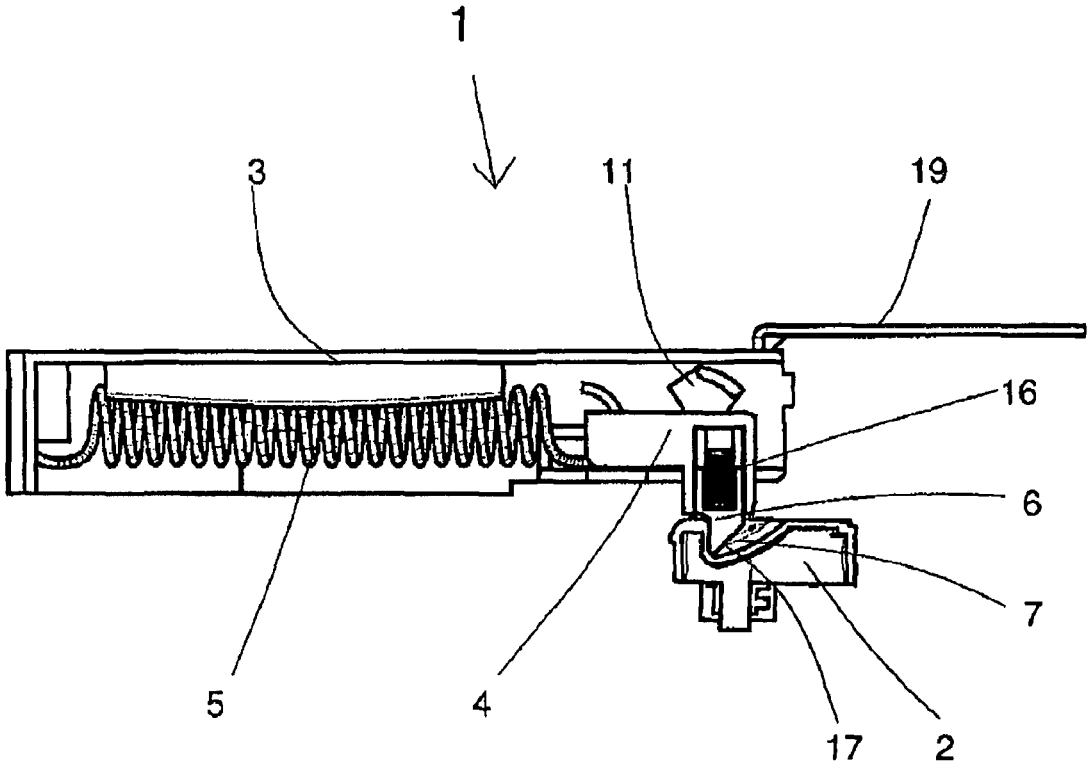
FIG. 2 The lock from FIG. 1 in locking engagement with the closing element, FIG. 3 A perspective view of the lock seen from one side, FIG. 4 A view of the lock as in FIG. 3 seen from the other side, FIG. 5 A cutaway view through the lock with the sliding carriage in the locking position, FIG. 6 A cutaway view as in FIG. 5, but seen from the opposite side, FIG. 7 A cutaway view through the lock with the sliding carriage in the unlocking position, and FIG. 8 A cutaway view as in FIG. 7, but seen from the opposite side.

The lock 1 has a casing 3 in which is arranged a sliding carriage 4 which can be moved between a locking position and an unlocking position. The locking position can be seen in greater detail in FIG. 5 and FIG. 6, and the unlocking position in FIG. 7 and FIG. 8. The sliding carriage 4 is loaded by means of a spring 5 in the direction of the locking position. A closing hook 6 is arranged on the sliding carriage 4. As FIG. 2 shows, when the closing element 2 is closed, said closing hook 6 can be made to engage with the closing element 2. For this purpose the closing hook 6 can be made to engage and lock with a cavity 7 in the closing element 2. When the closing element 2 is opened, the closing hook 6 disengages from the closing element 2 by leaving the cavity 7, though this is not shown in greater detail in the drawings.

Figure 3:
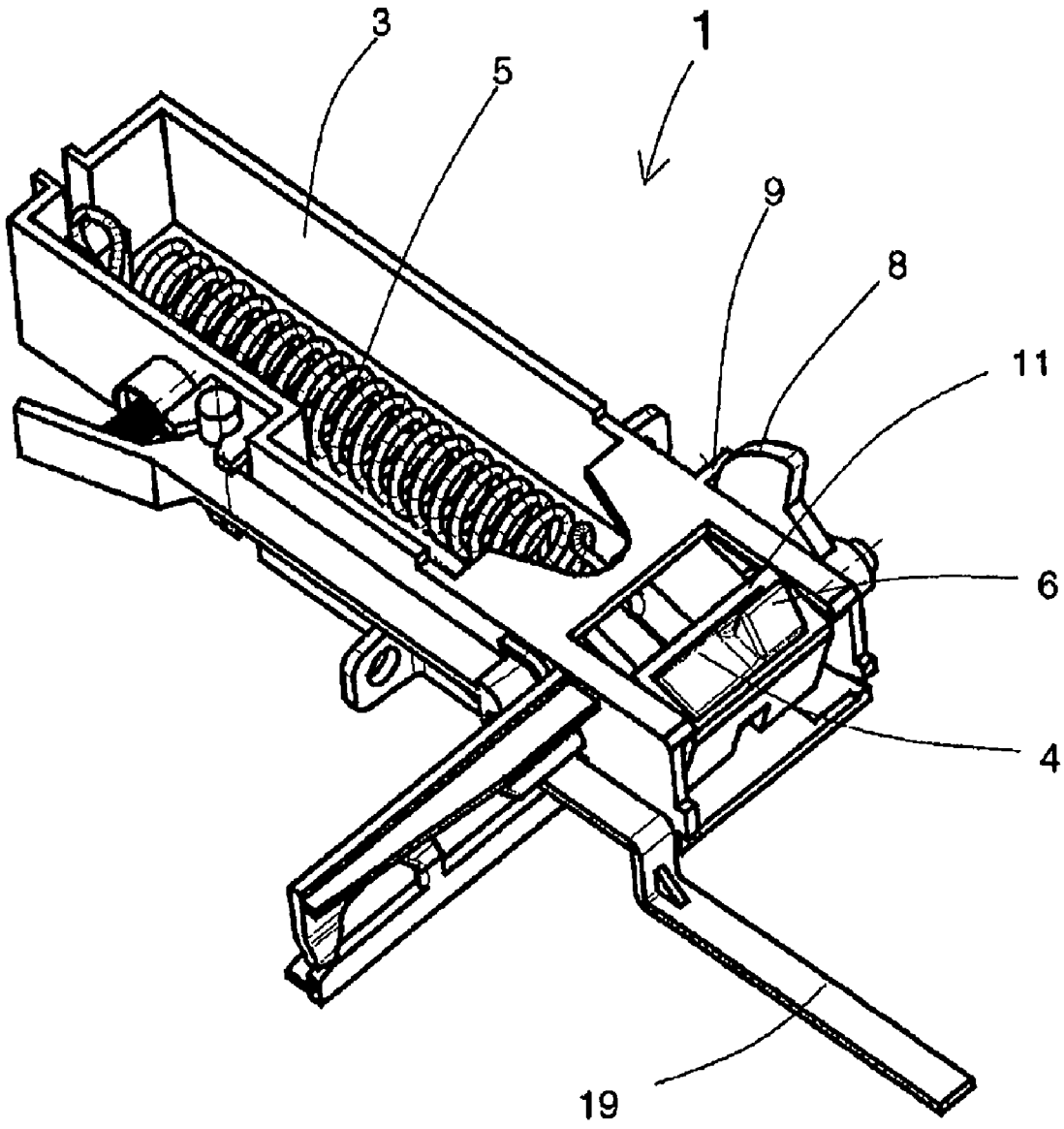
Figure 4:
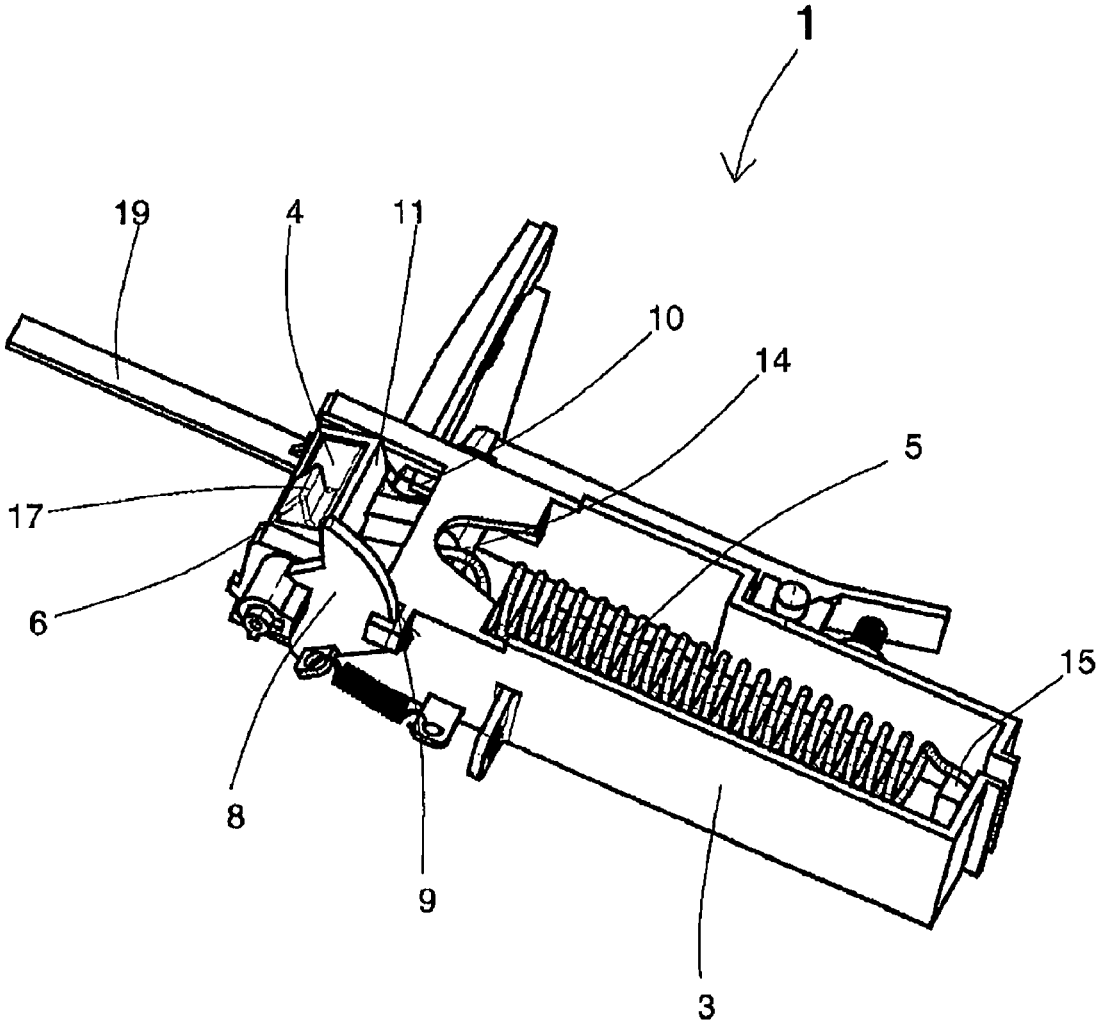

As can be further deduced from FIG. 1, a rotary door latch 8 is positioned in and/or on the casing 3 and can be rotated. When the closing element 2 is closed, the rotary door latch 8 can be made to operate in combination with the closing element 2. By operating together in this way, the rotary door latch 2 then actuates the sliding carriage 4 in such a way that when the closing element 2 is closed, the sliding carriage 4 is moved by the pressure of the spring 5 into the locking position shown in FIG. 5. For the purpose of operating in combination with the closing element 2, the rotary door latch 8 arranged on the side of the casing 3 juts out of the casing 3, for example at a type of aperture 9, or projects above the casing 3, as can be seen in FIG. 3 and FIG. 4.

Figure 5:
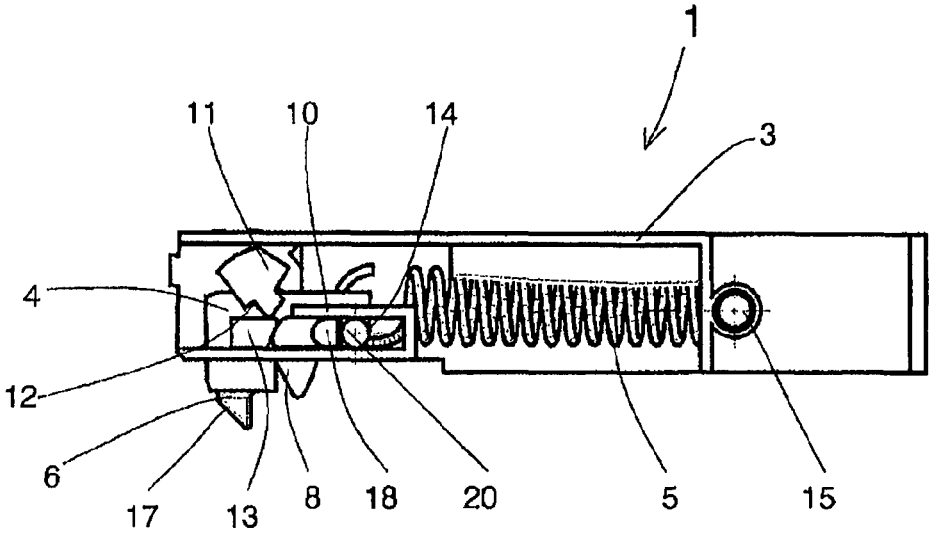
Figure 6:
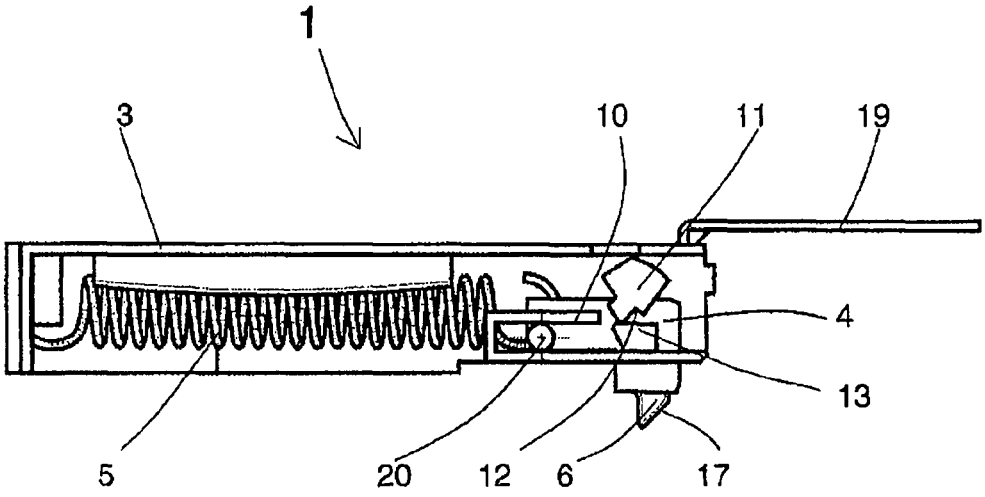
Figure 7:
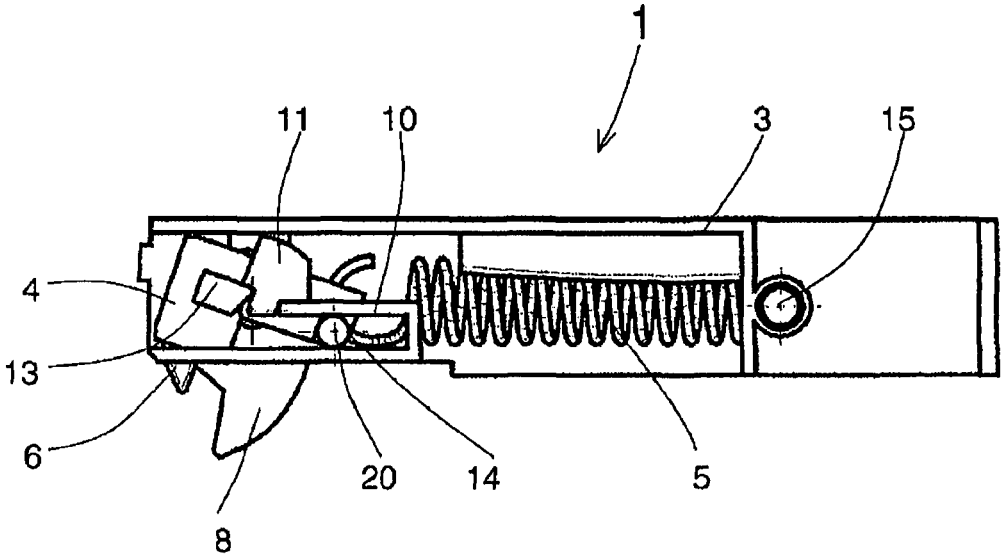
Figure 8:
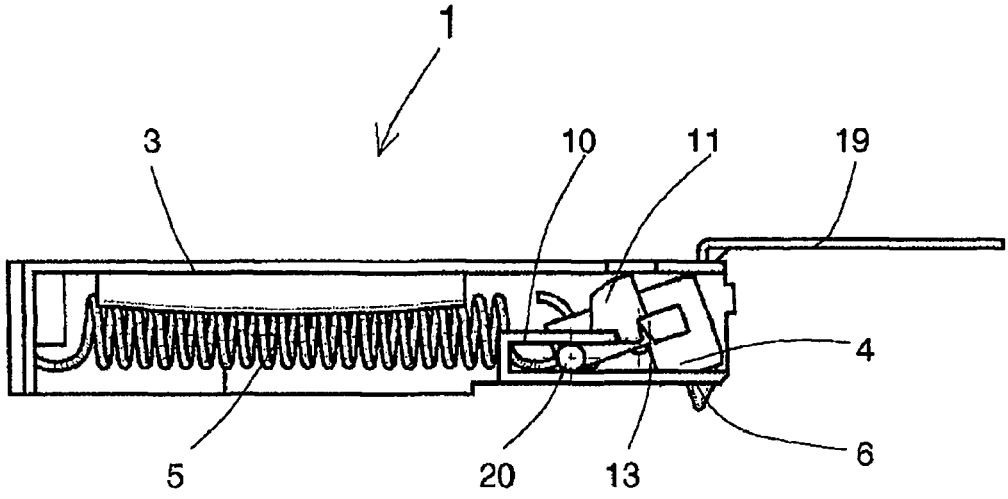

It can be seen from FIG. 5 or FIG. 7 that a guide 10 for the sliding carriage 4 is arranged in the casing 3 for the purpose of moving said sliding carriage 4 into the locking position. The rotary door latch 8 acts via a lever 11 on the sliding carriage 4, for which purpose a connecting member 12 is located on the lever 11. The connecting member 12 on the lever 11 then acts on the sliding carriage 4, in conjunction with a lug 13, in such a way that on the closing element 2 being closed, the lever 11 moves the sliding carriage 4 by means of dowel 20 in the guide 10.

The spring 5 is designed as a helical tension spring, and is suspended on an internal linkage 14 on the sliding carriage 4 and on an external linkage 15 in the casing 3. Moreover the external linkage 15 is offset relative to the internal linkage 14 in the locking position, as can be seen from FIG. 5, so that the spring 5 engages with the sliding carriage 4 in such a way that on the closing element 2 being opened a force acts on the sliding carriage 4 in the direction of the unlocking position.

The closing hook 6 is positioned in the sliding carriage 4 by means of a helical compression spring 16, as shown in FIG. 1. Furthermore the closing hook 6 has an oblique contact surface 17 (shown in FIG. 5) for the closing element 2, in order to provide so to speak a self-recovery effect which will be explained in greater detail below. Lastly in the locking position a stopper dowel 18 engages with the guide 10, blocking the movement of the dowel 20 in the sliding carriage 4. As a measure of child safety, on the closing element 2 being opened the stopper dowel 18 can be unlatched so that it no longer engages with the guide 10. A lever 19 which can be accessed from outside of the casing 3 is arranged on the casing 3 in order to actuate the stopper dowel 18 manually.

The operation of the inventive lock 1 and the path for pulling tight will now be explained in greater detail in the following sections, wherein for the sake of simplicity the closing element 2 will be called a door and the domestic appliance will be called a dishwasher.

By design the lock 1 holds the door 2 of the dishwasher closed with the aid of a closing pressure. The door 2 can be opened at any time by overcoming the said pressure.

When the door 2 is closed it actuates the rotary door latch 8. Together with the rotary door latch 8, the sliding carriage 4 with the closing hook 6 is moved downward over the lever 11 with the connecting member 12 until the sliding carriage 4, pulled by the tension spring 5, can slide backward into its guide 10. During the downward movement the closing hook 6 drops into a cavity 7 in the door 2 and pulls the door with it. The tension spring force pulls the door 2 against the rubber seal until the forces are in balance. This closing procedure is also explained in detail with the aid of FIG. 7.

On the door being opened, the closing hook 6 takes the sliding carriage 4 with it until the sliding carriage 4 can snap upward over the connecting member 12 of the lever 11. The door 2 is released. The rotary door latch 8 is returned to its original position by the lever 11. This opening procedure is also explained in detail with the aid of FIG. 5.

There is an additional function in the form of so to speak a self-recovery effect. There is a possibility that the rotary door latch 8 might be manually released by mistake without engaging the door 2. The lock 1 is in the closed position and the door 2 is still open. Against this possibility the closing hook 6 is positioned in the sliding carriage 4 by a spring and has an oblique contact surface 17 on its outside. The door 2 can be closed by this means when the lock 1 is in the closed position. The spring-loaded closing hook 6 is pressed into the sliding carriage 4 and then slides back into the cavity 7 in the door 2 as soon as said door is fully closed. When the door 2 is opened the lock 1 is in the correct position again.

A further, optional supplementary function is provided as a child safety feature against inadvertent opening of the door by children. To open the door 2, the lever 19, which is accessible from outside, must be used to unlatch the stopper dowel 18 which prevents the sliding carriage 4 from moving upward. The path for opening the door 3 to vent air in the event of excessive steam pressure is unobstructed. The child safety mechanism can be turned on and off. Even with the child safety mechanism locked, the door 2 can still be opened by using additional force, for example by pushing on the door 2 from inside.

The optimized solution according to the invention gives the following advantages. The closing pressure is reduced by relocating the tension spring suspension point in the sliding carriage 4. The lever 11 with the connecting member 12 is inventively built into the casing 3. A separate lever and the associated assembly procedure are not required. The rotary door latch 8 now moves the sliding carriage 4 directly downward with the aid of a lug 13. A spring is needed for standalone repositioning of the rotary door latch 8. The leg spring is replaced by a compression spring for improved assembly of the child safety mechanism. The relocation of the center of rotation is needed in order to increase the holding force.

The invention is not confined to the exemplary embodiment described and illustrated. On the contrary, it also includes all further technically competent developments in the context of the invention defined by the claims. For example the lock 1 can also be arranged in reverse order on the movable closing element 2, whereby the closing hook 6 then engages in the body of the domestic appliance. Moreover such a lock 1 can be used not only in domestic appliances, but also in motor vehicles, real estate or similar.

LIST OF REFERENCE CHARACTERS

1: Lock
2: Closing element/door
3: Casing
4: Sliding carriage
5: Spring/helical tension spring
6: Closing hook
7: Cavity
8: Rotary door latch
9: Aperture
10: Guide
11: Lever
12: Connecting member (on the lever)
13: Lug (on the sliding carriage)
14: Internal linkage (on the sliding carriage, for the spring)
15: External linkage (on the casing, for the spring)
16: Helical compression spring (for the closing hook)
17: Oblique contact surface
18: Stopper dowel
19: Lever (for actuating the stopper dowel)
20: Dowel (on the sliding carriage)

The invention claimed is:

1. A lock for a movable closing element, the lock comprising:

a closing hook selectively engageable with, and disengageable from, the movable closing element, the closing hook being engageable with the movable closing element in connection with a movement of the movable closing element into a closing position in which the movable closing element, operating especially as a door, a cover, a flap, or similar access opening closing element, closes off an access opening of a structure, especially a structure in the form of a domestic appliance such as a dishwasher, a washing machine, a refrigerator, and the closing hook being disengageable from the movable closing element in connection with a movement of the movable closing element into an opening position in which the movable closing element permits access via the access opening into the structure;

means forming a cavity in the movable closing element, the closing hook being disposable in the cavity in the movable closing element;

a sliding carriage movable between a carriage locking position and a carriage unlocking position, wherein the sliding carriage has a cavity, wherein the closing hook is mounted in the cavity of the sliding carriage, and wherein the closing hook is movable linearly within the cavity of the sliding carriage and in a direction transverse to the sliding carriage such that the closing hook is selectively engageable with, and disengageable from, the movable closing element; and a rotary door latch that cooperates with the movable closing element and with a lever to actuate movement of the sliding carriage between the carriage locking position and the carriage unlocking position.

2. The lock according to claim 1, wherein the closing hook is mounted in the sliding carriage in an arrangement via which a spring is connected to the closing hook and the sliding carriage and exerts a spring force relatively between the closing hook and the sliding carriage and the closing hook has a selected one of an oblique contact surface for the closing element and a non-oblique contact surface.

3. The lock according to claim 1, wherein the sliding carriage is arranged together with the closing hook on a body of a domestic appliance.

4. The lock according to claim 1, comprising:

a helical compression spring disposed between the closing hook and the sliding carriage and exerting a spring force relatively between the closing hook and the sliding carriage to move the closing hook linearly downward from the sliding carriage into the cavity.

5. A lock for a movable closing element, the lock comprising:

a closing hook selectively engageable with, and disengageable from, the movable closing element, the closing hook being engageable with the movable closing element in connection with a movement of the movable closing element into a closing position in which the movable closing element, operating especially as a door, a cover, a flap, or similar access opening closing element, closes off an access opening of a structure, especially a structure in the form of a domestic appliance such as a dishwasher, a washing machine, a refrigerator, and the closing hook being disengageable from the movable closing element in connection with a movement of the movable closing element into an opening position in which the movable closing element permits access via the access opening into the structure;

means forming a cavity in the movable closing element, the closing hook being disposable in the cavity in the movable closing element;

a sliding carriage movable between a carriage locking position and a carriage unlocking position, the closing hook being mounted on the sliding carriage, wherein the closing hook is movable linearly with respect to the sliding carriage and in a direction transverse to the sliding carriage;

a rotary door latch that actuates movement of the sliding carriage via a lever between the carriage locking position and the carriage unlocking position; and a stopper dowel, a guide, and a sliding carriage dowel and, in the carriage locking position, the stopper dowel being operable to block the sliding carriage dowel in the sliding carriage and being engaged with the guide and the stopper dowel being disengageable from the guide in connection with a movement of the movable closing element into an opening position and a selected one of a lever that can be accessed from outside of a casing for the lock and operable to manually actuate the stopper dowel and a non-lever configuration for actuating the stopper dowel.

6. The lock according to claim 5, wherein the closing hook is mounted in the sliding carriage in an arrangement via which a spring is connected to the closing hook and the sliding carriage and exerts a spring force relatively between the closing hook and the sliding carriage and the closing hook has a selected one of an oblique contact surface for the closing element and a non-oblique contact surface.

7. The lock according to claim 5, wherein the sliding carriage is arranged together with the closing hook on a body of a domestic appliance.

8. The lock according to claim 5, comprising:

a helical compression spring disposed between the closing hook and the sliding carriage and exerting a spring force relatively between the closing hook and the sliding carriage to move the closing hook linearly downward from the sliding carriage into the cavity.

9. The lock according to claim 7, wherein the domestic appliance is one of a dishwasher, a washing machine, and a refrigerator.

10. A lock for a movable closing element, the lock comprising:

a closing hook selectively engageable with, and disengageable from, the movable closing element, the closing hook being engageable with the movable closing element in connection with a movement of the movable closing element into a closing position in which the movable closing element, operating especially as a door, a cover, a flap, or similar access opening closing element, closes off an access opening of a structure, especially a structure in the form of a domestic appliance such as a dishwasher, a washing machine, a refrigerator, and the closing hook being disengageable from the movable closing element in connection with a movement of the movable closing element into an opening position in which the movable closing element permits access via the access opening into the structure;

means forming a cavity in the movable closing element, the closing hook being disposable in the cavity in the movable closing element;

a sliding carriage movable between a carriage locking position and a carriage unlocking position, the closing hook being mounted on the sliding carriage and movable linearly with respect to the sliding carriage and in a direction transverse to the sliding carriage;

a rotary door latch that actuates movement of the sliding carriage via a lever between the carriage locking position and the carriage unlocking position;

a guide for guiding the sliding carriage between the carriage locking position and the carriage unlocking position; and a sliding carriage dowel coupled to the sliding carriage and engaging the guide.

11. The lock according to claim 10, wherein the closing hook is mounted in the sliding carriage in an arrangement via which a spring is connected to the closing hook and the sliding carriage and exerts a spring force relatively between the closing hook and the sliding carriage and the closing hook has a selected one of an oblique contact surface for the closing element and a non-oblique contact surface.

12. The lock according to claim 10, wherein the sliding carriage is arranged together with the closing hook on a body of a domestic appliance.

13. The lock according to claim 10, comprising:

a helical compression spring disposed between the closing hook and the sliding carriage and exerting a spring force relatively between the closing hook and the sliding carriage to move the closing hook linearly downward from the sliding carriage into the cavity.

14. The lock according to claim 12, wherein the domestic appliance is one of a dishwasher, a washing machine, and a refrigerator.

15. A lock for a movable closing element of a domestic appliance, the lock comprising:

a closing hook selectively engageable with, and disengageable from, the movable closing element, the closing hook being engageable with the movable closing element in connection with a movement of the movable closing element into a closing position in which the movable closing element closes off an access opening of the domestic appliance, and the closing hook being disengageable from the movable closing element in connection with a movement of the movable closing element into an opening position in which the movable closing element permits access via the access opening into an interior of the domestic appliance;

a cavity in the movable closing element, the closing hook being disposable in the cavity in the movable closing element;

a sliding carriage movable between a carriage locking position and a carriage unlocking position, wherein the sliding carriage has a cavity, wherein the closing hook is mounted in the cavity of the sliding carriage, and wherein the closing hook is movable linearly within the cavity of the sliding carriage and in a direction transverse such that the closing hook is selectively engageable with, and disengageable from, the movable closing element; and a rotary door latch that cooperates with the movable closing element and with a lever to actuate movement of the sliding carriage between the carriage locking position and the carriage unlocking position.

16. The lock according to claim 15, wherein the domestic appliance is one of a dishwasher, a washing machine, and a refrigerator.

17. The lock according to claim 15, wherein the closing hook is mounted in the sliding carriage in an arrangement via which a spring is connected to the closing hook and the sliding carriage and exerts a spring force relatively between the closing hook and the sliding carriage and the closing hook has a selected one of an oblique contact surface for the closing element and a non-oblique contact surface.

18. The lock according to claim 15, wherein the sliding carriage is arranged together with the closing hook on a body of a domestic appliance.

19. The lock according to claim 11, comprising:

a helical compression spring disposed between the closing hook and the sliding carriage and exerting a spring force relatively between the closing hook and the sliding carriage to move the closing hook linearly downward from the sliding carriage into the cavity.

20. The lock according to claim 18, wherein the domestic appliance is one of a dishwasher, a washing machine, and a refrigerator.

* * * * *